United States Patent [19]

Williams

[11] 4,075,977

[45] Feb. 28, 1978

[54] MIXING HOPPER FOR MAGNETIC BRUSH DEVELOPING APPARATUS

[75] Inventor: James Ora Williams, Hilton, N.Y.

[73] Assignee: Eastman Kodak Company, Rochester, N.Y.

[21] Appl. No.: 758,539

[22] Filed: Jan. 12, 1977

[51] Int. Cl.[2] ..... G03G 15/09

[52] U.S. Cl. ..... 118/658; 118/644

[58] Field of Search ..... 118/658, 656, 657, 636, 118/644, 653; 355/3 DD; 427/18; 222/DIG. 1

[56] References Cited

U.S. PATENT DOCUMENTS

| | | | |
|---|---|---|---|
| 3,246,629 | 4/1966 | Shelffo | 118/658 |
| 3,572,922 | 3/1971 | Olden | 118/657 X |
| 3,659,556 | 5/1972 | Mutschler | 118/656 X |
| 3,697,050 | 10/1972 | Stanley | 118/658 X |
| 3,700,142 | 10/1972 | Waibel | 118/657 X |
| 3,707,947 | 1/1973 | Reichart, Jr. | 118/658 |
| 3,930,466 | 1/1976 | Stover | 118/658 |
| 3,939,800 | 2/1976 | Banker | 118/657 X |
| 3,943,887 | 3/1976 | Smith | 118/658 X |
| 3,946,910 | 3/1976 | Case | 222/DIG. 1 X |
| 3,985,098 | 10/1976 | Myers et al. | 118/644 |
| 3,999,514 | 12/1976 | Abott et al. | 118/657 |

FOREIGN PATENT DOCUMENTS

| | | | |
|---|---|---|---|
| 2,165,166 | 7/1972 | Germany | 355/3 DD |

*Primary Examiner*—Louis K. Rimrodt
*Assistant Examiner*—Andrew M. Falik
*Attorney, Agent, or Firm*—G. H. Childress

[57] ABSTRACT

A magnetic brush developing apparatus has a partitioned storage hopper which receives developer material returned from a transport roller in a developer station. Partitions in the hopper direct the flow of such material in one direction. A single auger receives such material when it approaches one end of the hopper and moves it in the opposite direction to the other end of the hopper. Material is metered from the hopper to a development roller and then to the transport roller.

8 Claims, 4 Drawing Figures

MIXING HOPPER FOR MAGNETIC BRUSH DEVELOPING APPARATUS

BACKGROUND OF THE INVENTION

The invention relates to electrophotographic apparatus having an improved developer station. More specifically, the invention relates to the manner in which the movement of developer material is controlled so that it is advanced in one direction incrementally each time it is cycled to developer and transport rollers, and moved in the opposite direction when it approaches one end of the developer station.

In electrophotographic copier/duplicators an electrostatic image of an original document is formed on a belt, drum or the like. The image is developed by applying toner particles thereto in a developer station. The toner particles are subsequently transferrred to a copy sheet and fused to the sheet to form a copy of the original document.

Major concerns in the design of a developer station are to minimize power requirements, provide adequate mixing and electrostatic charging of developer material, minimize changes in developer material properties due to aging, and to provide a stable and uniform flow of developer material. In developer station design, however, these concerns often conflict. For example, the desire for low power input may conflict with the need for good mixing of the developer material. This invention provides an arrangement of a partitioned storage hopper, one auger, and a magnetic transport roller, along with other components, to provide a desirable compromise among the major concerns referred to above.

Various types of apparatus have been devised for controlling the flow of developer material in a developer station. For example, U.S. Pat. Nos. 3,697,050 and 3,724,422 each disclose a cross-mixing baffle for controlling the mixing of developer material. The baffle has a plurality of chutes on one side which direct developer material in one lateral direction, and a plurality of similar chutes on the other side which direct developer material in the opposite direction. The number and size of the chutes are selected to equalize cross flow of the material in both directions. U.S. Pat. No. 3,707,947 also discloses cross-mixing apparatus wherein channels in one bank are slanted in one direction and channels in another bank are slanted in the opposite direction.

U.S. Pat. No. 3,943,887 teaches a hybrid cross-mixer comprising an auger-type "active" section and two "passive" sections. In the active section a right-hand helix and a left-hand helix mounted on the same shaft move developer from the central portion of the development zone outwardly toward the edges thereof. The two passive sections have baffles that deflect developer from the outer portions inwardly toward the center of the housing.

U.S. Pat. No. 3,947,107 illustrates an active cross-mixer having a pair of rotatable augers that are driven in opposite directions to advance developer along a sump. The sump has apertures therethrough so that the developer not only flows over the end of the baffles but also through the baffle, thereby distributing the developer across the sump.

The developer station disclosed in U.S. Pat. No. 3,949,704 comprises a cross-mixing baffle across which developer flows on the way to a screen, then through the screen and to an impeller which moves the developer toward the magnetic brushes. Similar disclosures are found in U.S. Pat. Nos. 3,906,898; 3,865,081 and 3,872,830.

Several patents show passive cross-mixing apparatus in combination with magnetic gates for controlling the flow of developer into the sump. These patents include U.S. Pat. Nos. 3,908,596; 3,927,640 and 3,930,466.

Lateral mixing of toner across the developer area, primarily by the use of two screws driven in opposite directions is discussed in U.S. Pat. Nos. 2,910,964; 3,912,388; 3,145,122 and 3,246,629.

U.S. Pat. No. 3,572,289 discloses cross-mixing baffles of the snow-plow type. The patent states that these baffles eliminate the need for power driven cross-mixing augers within a sump.

Canadian Pat. No. 951,114 discloses obstacles in the shape of pins or plows located along the flow path for developer for deflecting the developer and thereby directing it from a narrow band into a wider band.

SUMMARY OF THE INVENTION

It is an object of the invention to provide development station apparatus wherein adequate mixing and electrostatic charging of developer material is obtained while power requirements for operation of the station are minimized.

Another object of the invention is to provide a development station wherein change in developer material properties due to aging is minimized, and a stable and uniform flow of developer material in the development zone is achieved.

In a developer station for an electrophotographic copier or the like a developer roller provides developer material to a photoconductive member, and a transport roller conveys such material to the developer roller. The developer station of this invention comprises an elongate hopper having means defining a series of discrete storage compartments. The compartments of the hopper each receive through a top portion thereof developer material returned from the developer roller. The compartments taper downwardly relative to a horizontal plane so that developer material therein is urged by gravity toward the lower portion of the compartments. Means in the hopper deflects developer material laterally in one direction as it moves through each of the compartments. A single auger outside the compartments moves developer material in the opposite direction.

The invention, and its objects and advantages, will become more apparent in the following detailed description of the preferred embodiment.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Because developer apparatus are well known in the art, the present description will be directed in particular to elements forming part of, or cooperating more directly with, the present invention, elements not specifically shown or described herein being understood to be selectable from those known in the art.

Figure 1:
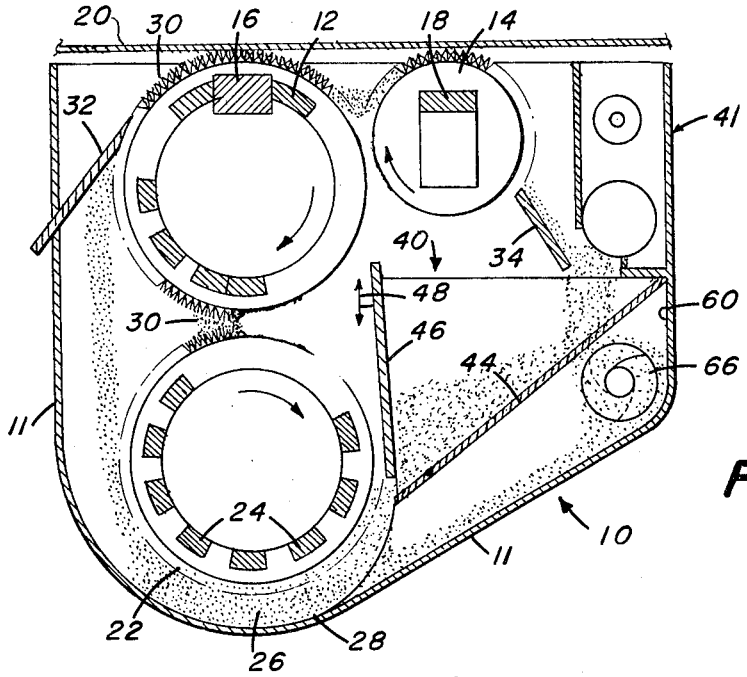
FIG. 1 is a cross-sectional view showing a portion of a copier/duplicator incorporating an improved developer station apparatus of the present invention.

Referring now to the drawings in detail, a developer station for an electrophotographic copier/duplicator or the like is generally designated 10 in FIG. 1. A housing 11 extends around the station. Within the housing are developer rollers 12 and 14 containing development zone magnets 16 and 18, respectively. A photoconductor, shown in the form of a web 20, passes in close proximity to rollers 12 and 14. A transport roller 22 having sector magnets 24 is positioned to pick up developer material 26 from a sump 28 and furnish such material to the developer rollers 12 and 14. The developer material flows along a path illustrated in FIG. 1 of the drawings by the numeral 30, and the thickness of the developer material on roller 12 is limited by a front skive 32 that is spaced a slight distance from the roller 12.

The developer material comprises finally divided particles of toner and carrier particles for the toner, the carrier particles typically being ferromagnetic in nature. The toner particles have an electrostatic charge created by tribo-electrification of the material. As the developer material comes in contact with oppositely charged portions of the web 20, some of the toner is transferred to the web and subsequently transferred to a copy sheet or support (not shown). Other portions of the toner and the carrier particles are transported along the right hand side of the roller 14 and removed therefrom by a rear skive 34. Developer material returned by skive 34 drops into a hopper generally designated 40, and is ultimately returned to the sump 28. A replenisher 41 furnishes toner particles to the hopper 40 where they are mixed with the carrier particles and other toner particles, thereby replenishing the developer material of toner carried away by the web 20.

Figure 2:
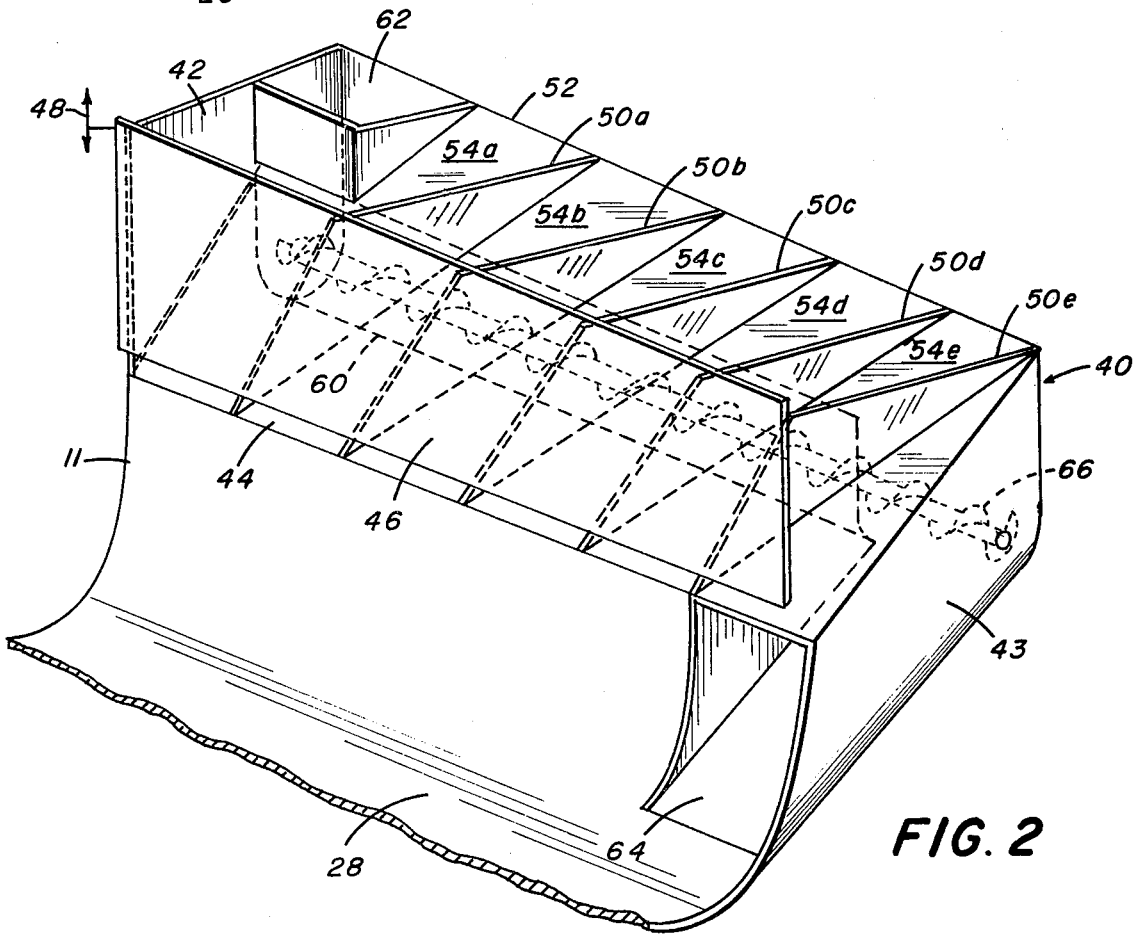
FIG. 2 is a perspective view of a portion of the apparatus shown in FIG. 1.
Figure 3:
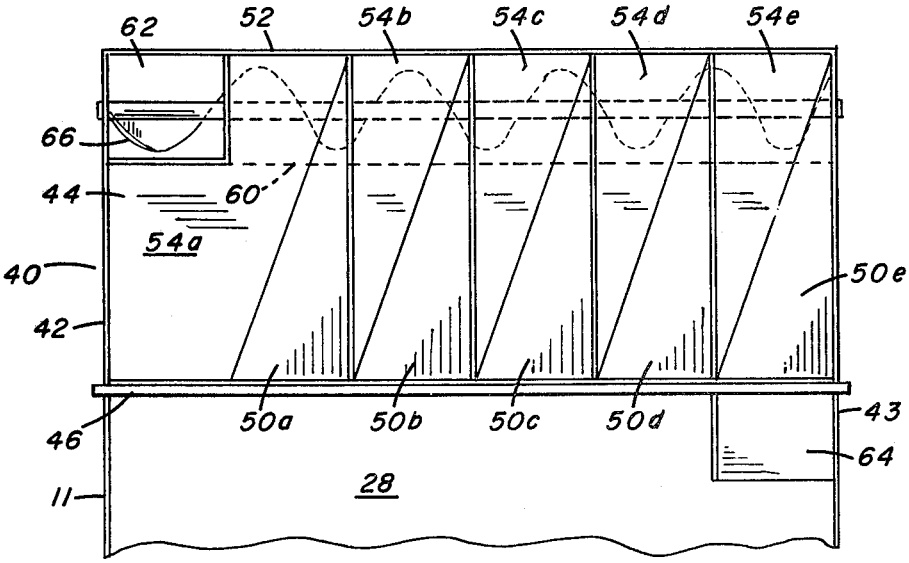
FIG. 3 is a plan view of the apparatus shown in FIG. 2.

Referring now to FIGS. 2 and 3, the housing 11 includes end walls 42 and 43 which define end walls of the hopper 40. Extending between the end walls is a bottom wall 44 that tapers downwardly relative to a horizontal plane and tapers toward one side of the hopper (the side shown in the bottom in FIGS. 2 and 3) so that any developer material in the hopper is urged by gravity toward that one side of the hopper. A gate 46 at the lower side of the hopper is adjustable in a vertical plane by means illustrated diagrammatically by the arrows 48. Adjustment of the gate relative to bottom wall 44 controls the flow of development material from the bottom wall into sump 28.

The hopper has a plurality of partitions which divide it into discrete storage compartments or chutes. While the number of partitions used may be varied, the drawing illustrates five such partitions which are designated **50*a*, 50*b*, 50*c*, 50*d* and 50*e*. Each of the partitions is mounted on the bottom wall 44 and extends across the hopper from the edge 52 of the hopper opposite from the gate 46 downwardly to the gate 46 to form five discrete storage compartments or chutes designated 54*a*–54*e*. The partitions 50*a*–50*e* are substantially parallel to each other so that the compartments are generally parallel to each other. The upper edge of each partition is generally parallel to the end walls 42 and 43; however, the edge of each partition that is mounted on the bottom wall 44 tapers from its upper end adjacent edge 52 of the hopper downwardly and toward the gate 46 and the end wall 42. Thus each of the partitions is inclined with respect to the ends of the hopper so that the compartments or chutes for the developer material serve to direct such material received through the top of the hopper toward the end 42 of the hopper and gate 46 as the material travels along the partitions and bottom wall 44** under the influence of gravity.

The hopper is open at the top and this permits developer material being returned to the hopper from the roller 14 to directly enter the various compartments **54*a*–54*e* and then move laterally a short distance toward end wall 42 as it travels through the hopper and back into the sump 28. As best shown in FIG. 3, the lower edge of each partition 50*a*–50*e* adjacent to gate 46 is offset relative to the upper edge thereof so that the lower edge is essentially below the upper edge of the next partition to the left. For example, the lower edge of partition 50*e* adjacent to gate 46 is substantially immediately below the upper edge of the partition 50*d* at the end thereof adjacent gate 46. Thus the exit from one storage compartment 54*a*–54*e* is aligned with the entrance of the succeeding storage compartment. For example, the exit of the compartment 54*e* at gate 46 is aligned with the entrance of compartment 54*d* adjacent to end 52 of the hopper. Because of this relationship, developer is incrementally advanced about one compartment width toward end wall 42 each time it moves through one compartment into the sump, around the various rollers 12, 14 and 22 and back into the next compartment. Ultimately each increment of developer material arrives at the left end partition of the hopper adjacent end wall 42**.

Means are provided for returning developer material from the end of the hopper adjacent wall 42 back to the end of the hopper adjacent wall 43. The means illustrated in the drawings for this function comprises a passageway 60 which extends from wall 42 to wall 43 beneath the bottom wall 44 of the hopper. Developer material enters the passageway through an entrance 62 adjacent wall 42 and leaves it through an exit chute 64 located adjacent wall 43 and below wall 44. The width of the entrance 62 and exit 64 for the passageway is substantially equal to the spacing between any two adjacent partitions **50*a*–50*e* so that developer material fed to the sump 28 from partition 50*a* generally is returned to the hopper through the entrance 62 to the passageway 60. Similarly, material leaving the passageway through chute 64 will furnish developer material to that portion of the sump immediately to the right of the material entering through the storage compartment 54*e*. Developer material is advanced through the passageway 60 by a return auger 66 that is located in the passageway and extends from wall 42 to wall 43. The auger is driven by any suitable means (not shown) in a direction to advance the developer material from the wall 42 toward wall 43. The exit chute 64 is inclined downwardly relative to a horizontal plane so that the material furnished to the chute by the auger flows by gravity into the sump 28**.

Figure 4:
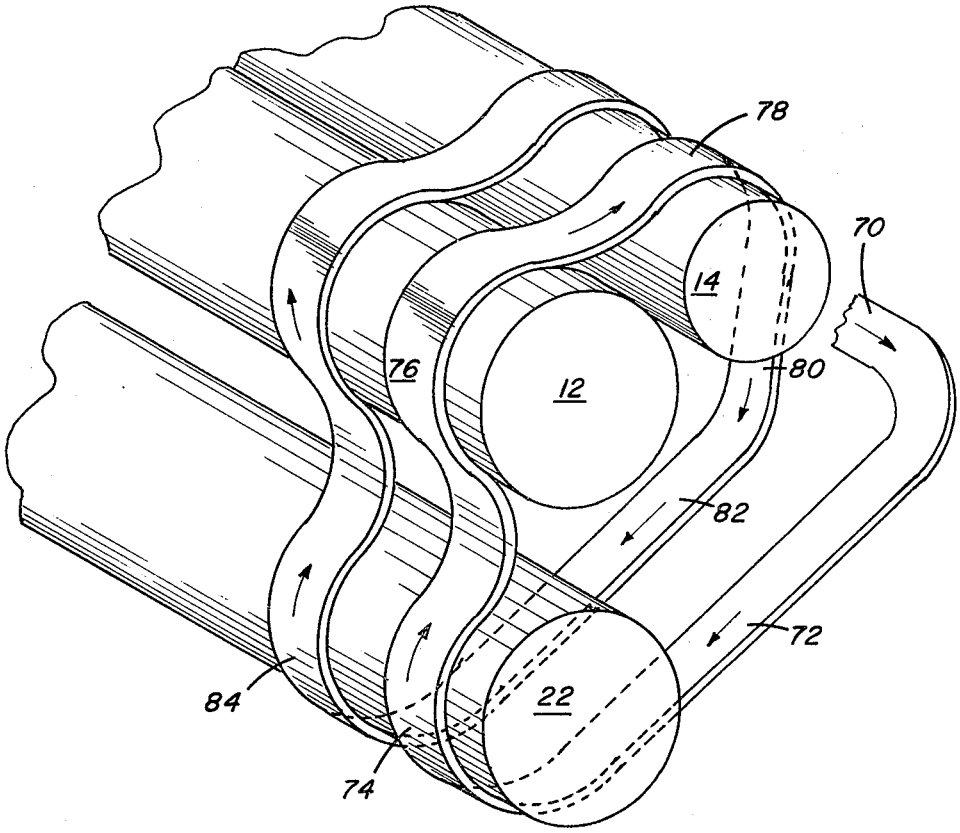
FIG. 4 is a schematic representation showing the flow of developer material in the development apparatus of the invention.

FIG. 4 schematically illustrates the flow of developer material. The numeral 70 designates the path of developer material as it travels along the passageway 60. The flow path of material traveling along chute 64 is shown at 72. As the material enters the sump it is picked up by roller 22 and thus moved along the path 74 around roller 22 near the right end portion thereof as viewed in the drawings. The material moves around the roller until it is transferred to roller 12 where it travels along the right end portion thereof as shown at 76. Similarly, the material is transferred to roller 14 and moves along the path designated as 78. As the material travels along the path portions 76 and 78, some of the toner is transferred to the web 20 and the remaining developer material is dropped off the back side of roller 14, as shown at 80, and enters the hopper where it is deflected along path 82 back to the sump.

The partitions 50*a*–50*e*, being of the same size and shape and located in parallel planes and in similarly positions with respect to other portions of the hopper, deflect the developer material along parallel paths so that it is offset somewhat toward wall 42 each time it leaves the hopper. Thus the material traveling along path 82 represents that portion of the developer in the storage compartment 54*e* between partitions 50*d* and 50*e*. As it leaves the hopper and is again furnished to the sump for pickup by roller 22, that material is offset toward wall 42 with respect to the portion of the material in path 72 and 74 which is furnished through chute 64. It then travels upwardly along a path 84. The material then travels in a path generally parallel to the paths 76, 78 and 80 until it is returned into the compartment 54*d* defined by the partitions 50*c* and 50*d*. While not shown in FIG. 4, it will be apparent that the developer material continues to be incrementally advanced toward wall 42 each time it cycles through the station. As material leaves the compartment 54*a* defined by the partition 50*a* and wall 42, it travels along a similar path, and when it leaves the roller 14 it is dropped into the entrance 62 into passageway 60 where it is returned by auger 66 along the path 70 to the right end of the hopper adjacent end wall 43. As mentioned previously, new toner material is provided by replenisher 41 into the chute 62 and each of the compartments of the hopper. The amount of material furnished to the sump can be controlled by adjustment of the gate 46.

As is apparent from the foregoing description, a well-defined and accurately controlled circulation path for developer material through the station is established by the apparatus of the present invention. There is a minimum amount of mechanical work done on the developer material, and this minimizes changes with time of the developers physical properties, i.e., aging. The use of the angled partitions in the storage hopper to direct the flow of developer material eliminates the need for one mechanical transporting device, such as an auger, used with many prior art devices. The use of the storage hopper can increase the amount of developer in the station and this too is desireable to minimize aging. Because only one auger is used, the power requirements are minimized. Moreover, the use of the storage hopper and a gate controlling the flow of material therefrom to the sump eliminates the compacting of developer material against roller 22 when it is not in operation. This prevents the occurrence of large start-up torque requirements which also reduces the power requirements.

The invention also reduces developer aging by allowing developer to flow and contact the photoconductor only when electrostatic images are actually to be developed. This is achieved by the present invention by the location of the transport roller 22 adjacent to the storage hopper exit gate. Because of the proximity of the core sector magnet to the gate, flow from the hopper will automatically stop, due to magnetic forces, when the transport roller stops. This same feature also is desireable from a flow control standpoint in that the same magnetic forces will act to draw out developer from the hopper when the transport roller rotates, thereby preventing flow blockages. To stop the flow, the transport roller and the return auger will both be stopped while both developer rollers continues to rotate and thus clean off their surfaces. To restart the flow, it is simply necessary to restart the transport roller and the return auger. Stable flow will be established in the development zone in about one second at typical roller speeds.

As mentioned previously, triboelectric charge between the toner and iron carrier particles is required for good operation. This can be accomplished by mechanical agitation of the developer material. The desired degree of charge is influenced by proper choice or selection of auger parameters such as pitch, diameter and the r.p.m. at which the auger is rotated.

Adequate mixing of developer material is needed to maintain a uniform concentration ratio of toner and carrier particles throughout the developer station since some of the toner particles are lost to image development on the web 20. This mixing can be enhanced by replenishing slowly over a large volume of developer, and is accomplished in the apparatus of this invention by locating the replenisher as shown in the drawings and dispensing the toner directly into the flowing stream of developer along substantially the entire length of rollers 12, 14 and 22.

The invention has been described in detail with particular reference to a preferred embodiment thereof, but it will be understood that variations and modifications can be effected within the spirit and scope of the invention.

I claim:

1. In a developer station of an electrographic copier or the like having a developer roller adapted to provide developer material to a photoconductor member and a transport roller for conveying such material to the developer roller, the improvement comprising:

an elongate hopper, means in the hopper defining a series of discrete storage compartments, said compartments of the hopper each receiving through a top portion thereof developer material returned from the developer roller, said compartments all tapering downwardly in the same direction relative to a horizontal plane so that developer material therein is urged by gravity toward a lower portion of each of the compartments, means in the hopper for deflecting developer material laterally in said one direction as it moves through each of the compartments, and a single auger outside the compartments for moving developer material in the opposite direction.

2. In a developer station for an electrographic copier/duplicator wherein developer material comprising toner is circulated along an endless path from a transport roller to a developer roller, from which toner is furnished to a photoconductor, and then back to the transport roller, the improvement comprising:

a series of discrete storage compartments for developer material disposed along the developer path between the developer roller and the transport roller, the compartments comprising a bottom wall and a plurality of partitions positioned on the bottom wall to deflect developer material laterally with respect to the transport roller in one direction only so that developer material is moved incrementally in said one direction as it circulates along the path;

means defining an elongate passageway having an inlet for developer material adjacent one end of the compartments and an exit for such material adjacent the other end of the compartments; and an auger in said passageway for returning the developer material in the opposite direction along a path separate from the compartments.

3. In a developer station for an electrographic copier/duplicator wherein developer material comprising toner is circulated along an endless path from a transport roller to a developer roller, from which toner is furnished to a photoconductor, and then back to the transport roller, the improvement comprising:

an elongate hopper, the hopper being open at the top thereof and positioned with respect to the endless path to receive developer as it travels between the developer roller and the transport roller, the hopper having an opening through which developer material can flow to the transport roller, a gate for adjusting the size of the hopper opening to permit sufficient developer material to be furnished to the photoconductor by the rollers and to retain in the hopper a major portion of the developer material, whereby developer material is accumulated in the hopper and aging of such material is thereby minimized, the hopper having a bottom wall tapered downwardly and toward the opening so that developer material can flow toward the opening under the influence of gravity, means on the bottom wall for directing developer material incrementally toward a first end of the hopper as it moves along the bottom wall; and means for moving developer material from said first end of the hopper to a second end of the hopper along a path below the bottom wall of the hopper.

4. In a developer station of an electrographic copier or the like having a developer roller adapted to provide developer material to a photoconductive member and a transport roller for conveying such material to the developer roller, the improvement comprising:

an elongate hopper having first and second ends spaced from each other and a bottom wall extending between the ends, the hopper further comprising a plurality of partitions mounted on the bottom wall and extending across the hopper to form in the hopper a series of discrete storage compartments, said compartments of the hopper each having an opening at the top thereof to receive developer material returned from the developer roller, said bottom wall tapering downwardly relative to a horizontal plane toward one side of the hopper so that developer material in the compartments is urged by gravity toward said one side of the hopper, an adjustable gate at said one side of the hopper for controlling the flow of developer material from said compartments, each of said partitions occupying a position with respect to said bottom wall of the hopper to direct the flow of developer material received from the developer roller laterally along said bottom wall toward said first end of the hopper before such material leaves the hopper past the gate, said partitions having upper edges generally parallel to the ends of the hopper and lower edges that are inclined with respect to the ends of the hopper;

means defining a passageway from said first end of the hopper to said second end of the hopper, said passageway having an inlet opening adjacent said first end of the hopper for receiving a portion of the developer material from the developer roller and an exit opening adjacent said second end of the hopper through which developer material can be delivered from the passageway to the transport roller; and a single auger in said passageway for moving developer material through the passageway from its inlet opening to its outlet opening.

5. In a developer station of an electrographic copier or the like having a developer roller adapted to provide developer material to a photoconductive member and a transport roller for conveying such material to the developer roller, the improvement comprising:

an elongate hopper having first and second ends spaced from each other and a bottom wall extending between the ends, the hopper further comprising a plurality of partitions mounted on the bottom wall and extending across the hopper to form in the hopper a series of discrete storage compartments, said compartments of the hopper each having an opening at the top thereof to receiver developer material returned from the developer roller, said bottom wall tapering downwardly relative to a horizontal plane toward one side of the hopper so that developer material in the compartments is urged by gravity toward said one side of the hopper, an adjustable gate at said one side of the hopper for controlling the flow of developer material from said compartments, each of said partitions occupying a position with respect to said bottom wall of the hopper to direct the flow of developer material received from the developer roller laterally along said bottom wall toward said first end of the hopper before such material leaves the hopper past the gate, said partitions being substantially parallel to each other and spaced from adjacent partitions by substantially the same distance so that the compartments divide developer material in the hopper into parallel paths extending downwardly and toward said one end of the hopper;

means defining a passageway from said first end of the hopper to said second end of the hopper, said passageway having an inlet opening adjacent said first end of the hopper for receiving a portion of the developer material from the developer roller and an exit opening adjacent said second end of the hopper through which developer material can be delivered from the passageway to the transport roller; and means for moving developer material through the passageway from its inlet opening to its outlet opening.

6. In a developer station as set forth in claim 5 wherein said passageway extends beneath said bottom wall of the hopper, and the exit opening from the passageway is positioned with respect to said partitions to deliver developer material from the passageway along a path between the second end of the hopper and the path for developer material delivered from the compartment nearest said second wall.

7. In a developer station as set forth in claim 5 wherein the end of each compartment nearest the gate is offset toward said one wall from the other end of the compartment by a distance substantially equal to the distance between adjacent partitions whereby the developer material is offset toward said one wall by a distance equal to the width of a compartment each time said material passes through the hopper.

8. In a developer station of an electrographic copier or the like having a developer roller adapted to provide developer material to a photoconductive member and a transport roller for conveying such material to the developer roller, the improvement comprising:

an elongate hopper having first and second ends spaced from each other and a bottom wall extending between the ends, the hopper further comprising a plurality of partitions mounted on the bottom wall and extending across the hopper to form in the hopper a series of discrete storage compartments, said compartments of the hopper each having an opening at the top thereof to receive developer material returned from the developer roller, said bottom wall tapering downwardly relative to a horizontal plane toward one side of the hopper so that developer material in the compartments is urged by gravity toward said one side of the hopper, an adjustable gate at said one side of the hopper for controlling the flow of developer material from said compartments, each of said partitions occupying a position with respect to said bottom wall of the hopper to direct the flow of developer material received from the developer roller laterally along said bottom wall toward said first end of the hopper before such material leaves the hopper past the gate;

means defining a passageway from said first end of the hopper to said second end of the hopper, said passageway having an inlet opening adjacent said first end of the hopper for receiving a portion of the developer material from the developer roller and an exit opening adjacent said second end of the hopper by passing said gate through which developer material can be delivered from the passageway to the transport roller; and means for moving developer material through the passageway from its inlet opening to its exit opening.

* * * * *